US005455981A

United States Patent [19]

Wiese

[11] Patent Number: 5,455,981

[45] Date of Patent: Oct. 10, 1995

[54] PAINT SCRAPER

[76] Inventor: Steven R. Wiese, 11400 Quincy St. NE., Blaine, Minn. 55434

[21] Appl. No.: 266,488

[22] Filed: Jun. 27, 1994

[51] Int. Cl.[6] ..... A47L 13/022; A47L 13/08

[52] U.S. Cl. ..... 15/236.01; 15/143.1; 15/236.02; 16/110 R; 30/169

[58] Field of Search ..... 15/143.1, 144.1, 15/145, 236.01, 236.02, 236.5–236.09; 30/169, 296.1, 298, 312, 314; 294/25, 57, 58; 16/110 R

[56] References Cited

U.S. PATENT DOCUMENTS

| | | | |
|---|---|---|---|
| 407,571 | 7/1889 | Calef . | |
| 712,843 | 11/1902 | Paul . | |
| 2,244,585 | 6/1941 | Tweit | 97/71.1 |
| 2,482,589 | 9/1949 | Maguire | 294/58 |
| 2,958,086 | 11/1960 | Scully | 15/143 |
| 4,481,689 | 11/1984 | Westmorland | 15/236 R |
| 4,888,846 | 12/1989 | Natale | 15/236.01 |
| 4,890,351 | 1/1990 | Wilson | 15/236.01 |
| 4,962,561 | 10/1990 | Hamilton | 15/111 |
| 5,133,101 | 7/1992 | Hauser et al. | 15/143.1 |

FOREIGN PATENT DOCUMENTS

| | | | |
|---|---|---|---|
| 331025 | 12/1920 | Germany | 15/236.01 |

*Primary Examiner*—Edward L. Roberts, Jr.
*Attorney, Agent, or Firm*—Jacobson & Johnson

[57] ABSTRACT

An improved paint scraper to permit a user minimum arm fatigue and cramping due to the paint scraper including a blade for scraping paint from a surface by pulling or pushing the blade along the surface while the blade is held in pressure contact with the surface. The paint scraper includes a handle carrying the blade with the handle having a first cylindrical portion suitable for grasping in different hand positions with a thumb and fingers of a user's hand and a lever arm extending from the handle, with the lever arm extending substantially at a right angle to the handle and having an opening therein sufficiently large so as to permit insertion and repositioning of a user's forearm therein with the lever arm having an arm cradle having an arcuate shape for engaging an extended portion of a user's forearm with the arm cradle extending substantially crosswise across a portion of the forearm of the user's forearm so that when the user's fingers and thumb grasp the handle the user's forearm engages the arm cradle to permit application of pressure to the blade through both the hand and the forearm of the user even though the user may periodically reposition his or her hand and forearm on the paint scraper.

5 Claims, 2 Drawing Sheets

PAINT SCRAPER

FIELD OF THE INVENTION

This invention generally relates to paint scrapers and more particularly, to improvements to paint scrapers that allow a user to reposition his or her hand on the scraper, apply greater pressure to the paint scraper as well as permit the paint scraper to be effectively used in removing paint from surfaces regardless of their angular location with respect to the user.

BACKGROUND OF THE INVENTION

The concept of scrapers and more specifically, paint scrapers is old in the art. In general paint scrapers have a handle with a blade that is held in pressure contact with a surface from which paint is to be removed. Typically, the blade extends at about 90 degrees to the surface to be scraped and a user pulls and pushes the blade over the painted surface to remove the paint.

One of the problems with paint scrapers is that, in order for the paint scraper to be effective, the user must continually apply pressure to the paint scraper as the paint scraper is pushed or pulled across the painted surface. If the surface to be scraped is large the muscles in a persons hand and wrist quickly become fatigued and cramped due to the need to continually apply pressure to the scraper while pushing and pulling on the scraper. One of the methods of reducing the pressure on a user's hand or wrist is to use a forearm support in conjunction with a scraper.

One such forearm support is shown in the asbestos scraper shown in U.S. Pat. No. 4,888,846 which shows an extension bracket with an annular arm ring for extending around the user's arm. This device, while providing substantial engagement with the user's forearm, utilizes a hand grip that is parallel to the blade of the scraper and perpendicular to the central shaft of the scraper. Unfortunately, the construction of the forearm support and the hand grip shown in the patent makes it both awkward and difficult to apply pressure to the blade other than in an axial direction along the shaft of the scraper. The orientation of the blade at an angle substantially parallel to the plane of the user's arm makes it suitable for removing asbestos by a pushing action but not by a pulling action.

Still another similar forearm support for an ice scraper is shown in U.S. Pat. No. 4,962,561. The ice scraper is used for removing ice from the windshield of an automobile. In this case, fatigue is typically not a problem because windshield ice can be removed in a few seconds. The ice scraper has a forearm support having a looped section that extends outward from the scraper and gradually curves upward to form a loop around the user's forearm. While this type of forearm support allows one to apply pressure with the forearm, it is not suitable for use over an extended period of time as the combination of the hand grasping area and looped section causes fatigue and cramping of the muscles in the user's arm.

The present invention addresses the problems of needing to apply pressure on a paint scraper for an extended period of time without fatiguing the user's arm. The forearm support of the present invention permits the user to apply pressure to the paint scraper blade even if the surface to be scraped is located at an odd angle to the user's body. Also by utilizing a scraper with a cylindrical handle that extends substantially perpendicular to the blade of the paint scraper in conjunction with the forearm support of the present invention, one can apply pressure for an extended period of time without fatiguing the arm. The present invention includes an arm cradle that engages an extended portion of the user's forearm to minimize pressure spots on the user's forearm. In addition, the cylindrical handle and the forearm support coact to allow the user to periodically reposition his or her hand and forearm during the scraping operation to further eliminate muscle fatigue and cramps due to extended paint scraping operations.

BRIEF DESCRIPTION OF THE PRIOR ART

U.S. Pat. No. 407,571 shows a knife for cutting corn with the knife having a hand grip and a forearm support formed in the shank of the knife handle.

U.S. Pat. No. 5,133,101 shows a hand grip and a forearm support with the forearm support used to twist and turn the mop handle to avoid hand callouses.

U.S. Pat. No. 4,481,689 shows a scraping tool with only a hand grip.

U.S. Pat. No. 712,843 shows a pneumatic sugar cane cutter with a hand grip and a forearm support extending substantially perpendicular to the blade of the cane cutter.

U.S. Pat. No. 2,244,585 shows a supplemental handle for a device such as a hoe.

U.S. Pat. No. 2,482,589 shows an implement holder with both the hand grip and a forearm support extending substantially perpendicular to the implement held therein.

U.S. Pat. No. 2,958,086 shows a bath brush with a wrist support to hold the brush proximate the user's hand.

U.S. Pat. No. 4,890,351 shows food scraper with a guard to prevent the user's hand from accidently coming in contact with a hot griddle or the like.

U.S. Pat. No. 4,888,846 shows an abestos scraper with an extension bracket with an annular arm ring for extending around the user's arm. This device while providing substantial engagement with the user's forearm utilizes a hand grip that is parallel to the blade of the scraper and perpendicular to the central shaft of the scraper. This device is not suitable for exerting force in both a pulling and pushing action.

U.S. Pat. No. 4,962,561 shows an ice scraper with a forearm support for removing ice from the windshield of an automobile. The ice scraper forearm support uses a looped section that extends outward from the scraper and gradually curves upward to form a loop around the user's forearm.

SUMMARY OF THE INVENTION

An improved paint scraper to permit a user to minimize the fatigue and cramping of the user arm with the paint scraper including a blade for scraping paint from a surface by pulling or pushing the blade along the surface while the blade is held in pressure contact with the surface. A handle carrying the blade with the handle having a first cylindrical portion suitable for grasping in different hand positions with a thumb and fingers of a user's hand. The paint scraper includes a lever arm extending from the handle, with the lever arm extending substantially at a right angle to the handle and having an opening therein sufficiently large so as to permit insertion of a users forearm therein. The lever arm having an arm cradle having an arcuate shape for engaging an extended portion of a user's forearm with the arm cradle extending crosswise across a portion of the forearm of the user's forearm so that when the user's fingers and thumb grasp the handle the user's forearm engages the arm cradle to permit application of pressure to the blade through both the hand and the forearm of the user even. The shape of the handle and the arm cradle allow the user periodically reposition his or her hand and forearm on the paint scraper so that different muscles and portions of muscles can be used to thereby minimize muscle fatigue and muscle cramps.

DESCRIPTION OF THE PREFERRED EMBODIMENT

Figure 1:
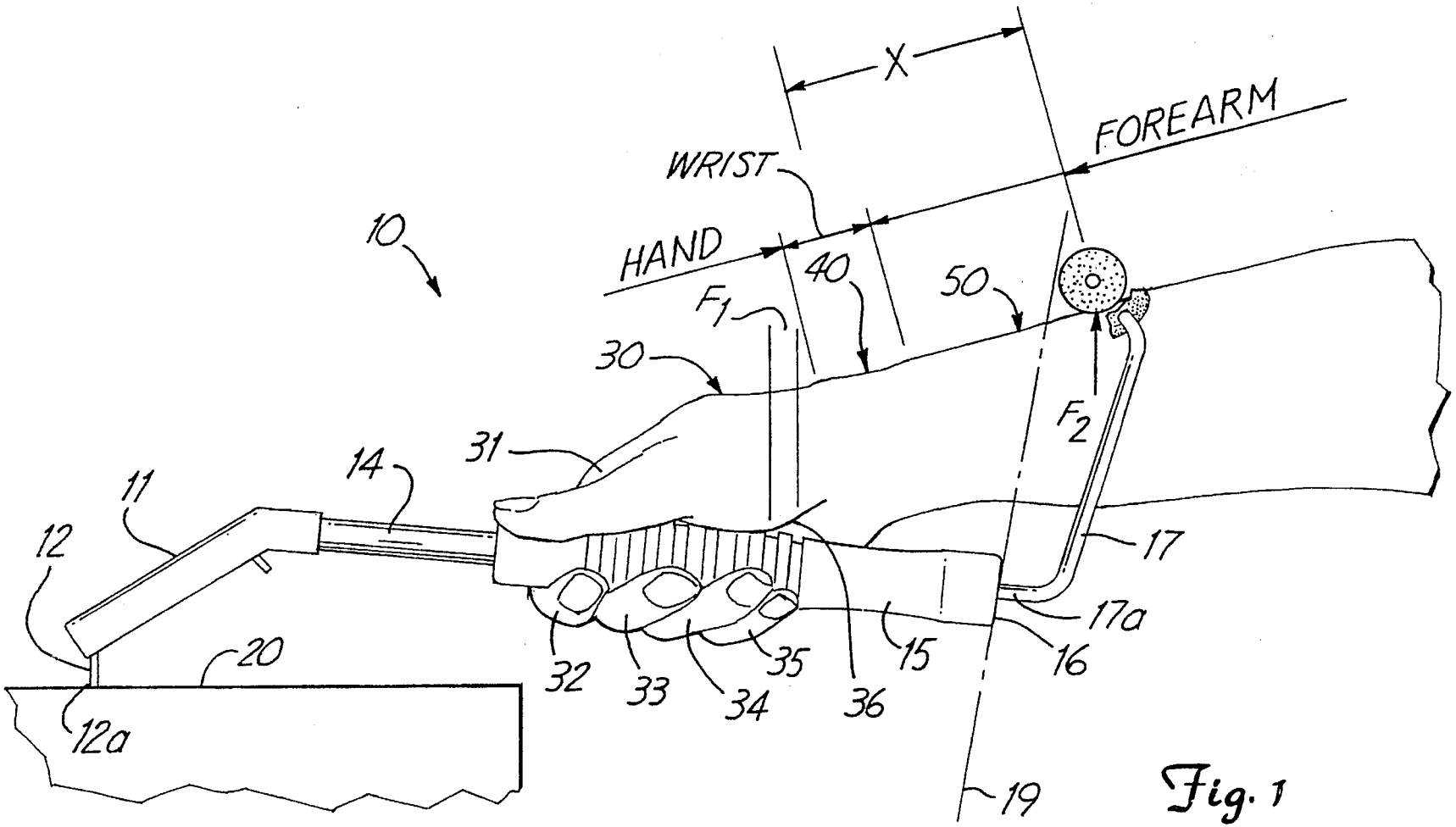
FIG. 1 shows a side view of the paint scraper of the present invention with a user engaging the hand and forearm support of the paint scraper.
Figure 2:
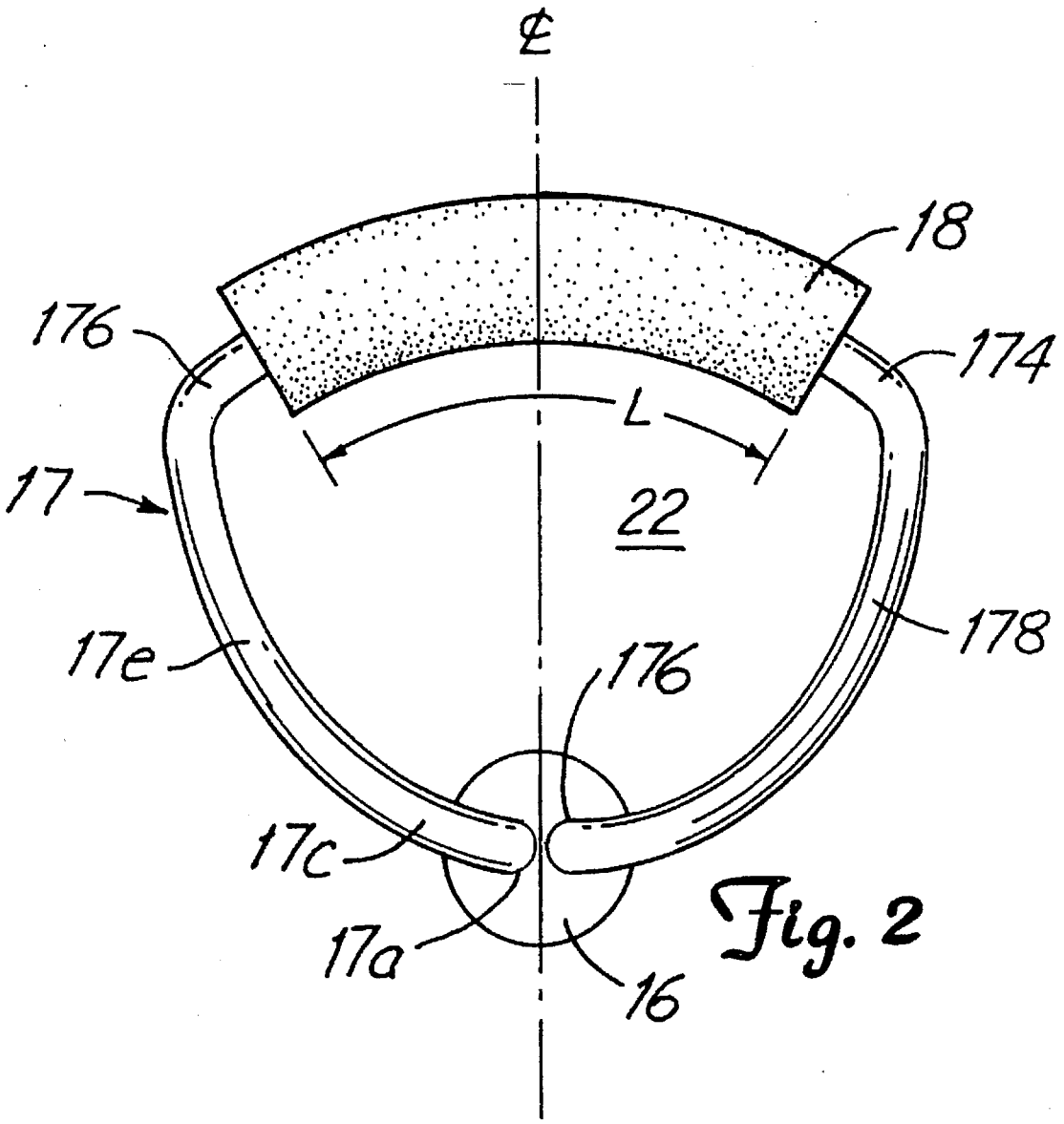
FIG. 2 shows a rear view of the paint scraper of FIG. 2.

Referring to the drawings FIG. 1 and FIG. 2 show an improved paint scraper 10 to minimize the muscle fatigue and muscle cramping in a users arm. The paint scraper includes a blade 12 having a blade edge 12*a* for scraping paint from a surface 20 by pulling or pushing the blade along the surface while the blade is held in pressure contact with the surface. A workhead 11 holds the blade 12 thereon with a cylindrical handle having a front portion 14 and a rear portion 15. A handle front portion 14 has a first cylindrical hand gripping portion suitable for grasping in different hand positions with respect to a thumb 32 and fingers 31, 33, 34, and 35 of a user's hand 30. That is, the user's hand and forearm may be positioned as shown in FIG. 1 or the user can rotate the hand and forearm in a clockwise or counter clockwise direction and still maintain a firm grip on the handle from a different hand orientation.

The paint scraper includes a lever arm 17 as a continuous member extending from end 16 of handle 14 and 15. The lever arm 17 is shown extending substantially at a right angle to handle 15 and having an opening therein sufficiently large so as to permit insertion of a user's forearm therein. FIG. 2 shows lever arm 17 having a symmetric appearance and comprised of members 17*a* and 17*d* which extend upward to engage symmetric members 17*c* and 17*d*. Symmetric members 17*c* and 17*d* extend upward to respectively engage symmetric members 17*e* and 17*f* which in turn engage symmetric members 17*g* and 17*h* which connect to each other to form an arcuate shaped arm cradle with a resilient foam arm cradle cushion 18 located thereon. Cushion 18 extends over a distance L which is sufficiently long so as to engage an extended arcuate portion of the user's arm to thereby eliminate pressure points by distributing pressure forces over an extended area of the users arm. Typically, cushion 18 should have a minimum length of about 2 inches and a diameter of about ½ inch to ensure that the pressure from the lever arm is distributed over an extended area in both the lateral and longitudinal portions of the user's forearm.

FIG. 1 shows a user arm with a hand portion 30, a wrist portion 40 and a forearm portion 50. Arrow $F_1$ indicates the direction of downward pressure extends to the heel area of the user's hand. Arrow designated by $F_2$ indicates the upward pressure on the user's arm against arm cradle cushion 18. The dimension X indicates that the area of engagement of the user's forearm 50 with arm cradle cushion 18 is located substantially behind the wrist area 40. Consequently, one need not rely on only hand or wrist pressure but one can obtain leverage on blade 12 from the coaction of forearm 50 arid hand 30 with paint scraper 10.

A further feature of the invention is that handle portion 14 extends substantially perpendicular to blade 12 and the hand and arm make a slight acute angle with respect to each other. This enables the user to position his or her hand in different circumferential positions on handle 14. In addition the open symmetric shape of lever arm 17 and arm cradle cushion 18 allows one to rotate the forearm within the lever arm 17 and still maintain contact between the forearm and the arm cradle cushion 18. Consequently, by repositioning the hand and forearm the user can continue to apply pressure and also avoid muscle fatigue. That is, by being able to periodically reposition his or her hand and forearm on the paint scraper one engages different muscles thereby avoiding the fatiguing of one set of muscles. Typically, one can orientate one's hand 30 to 40 degrees with respect to the handle portion 15. Note, the arcuate shape of the arm cradle cushion 18 permits extended engagement with a portion of a user's forearm even though the arm may be slightly rotated. With the arm cradle cushion extending crosswise and substantially perpendicular to a portion of the forearm of the user's forearm the user's fingers and thumb can grasp the handle while the user's forearm engages the arm cradle to permit application of increased pressure to the blade through the lever like coaction between both the hand and the forearm of the user.

I claim:

1. An improved paint scraper to permit a user to apply increased pressure to the paint scraper to help eliminate muscle fatigue comprising;

a blade for scraping paint from a surface by pulling or pushing the blade along the surface while the blade is held in pressure contact with the surface;

a handle carrying the blade, said handle having a first cylindrical portion suitable for grasping in different positions with a thumb and fingers of a user's hand, said handle having an end portion, said handle located transverse to the blade with said blade having a straight edge for working against a painted surface to remove paint during both a pulling or pushing stroke;

a lever arm extending from said end portion of said handle, said lever arm including a reverse angle portion to maintain the lever arm substantially at a right angle to said handle, said lever arm having an opening therein sufficiently large so as to permit insertion and repositioning of a user's forearm therein and repositioning of a user's hand on said handle to thereby allow a person to use a different set of muscles and help eliminate muscle fatigue, said lever arm having an arm cradle having an arcuate shape with a resilient pad to distribute forces and absorb impacts for engaging an extended portion of a user's forearm, said arm cradle extending crosswise across a portion of the user's forearm so that when the user's fingers and thumb grasp the handle the user's forearm engages the arm cradle to permit application of pressure to the blade through both the hand and the forearm of the user.

2. The paint scraper of claim 1 wherein the lever arm extends axially outward from the blade.

3. The paint scraper of claim 1 wherein the lever arm is made of metal.

4. The paint scraper of claim 1 wherein the arm cradle is positioned rearwardly of the handle of the paint scraper.

5. The paint scraper of claim 1 wherein the blade of the paint scraper is located at about a 90 degree angle to the handle of the paint scraper to allow the paint scraper to be pulled or pushed across a surface.

* * * * *